US008152706B2

(12) United States Patent
Hsu

(10) Patent No.: US 8,152,706 B2
(45) Date of Patent: Apr. 10, 2012

(54) METHOD AND MECHANISM FOR ROLLING AN OPENING PERFORATION LINE

(75) Inventor: Wei-Hsin Hsu, Taipei (TW)

(73) Assignee: Chan Li Machinery Co., Ltd., Taoyuan (TW)

( * ) Notice: Subject to any disclaimer, the term of this patent is extended or adjusted under 35 U.S.C. 154(b) by 400 days.

(21) Appl. No.: 12/585,019

(22) Filed: Sep. 1, 2009

(65) Prior Publication Data

US 2010/0248925 A1 Sep. 30, 2010

(30) Foreign Application Priority Data

Mar. 31, 2009 (TW) ..... 98110682 A

(51) Int. Cl.
*B31B 1/14* (2006.01)

(52) U.S. Cl. ..... 493/370; 493/365; 493/241; 83/331; 83/348; 83/345; 83/496

(58) Field of Classification Search ..... 493/365–368, 493/370, 371, 241; 83/331, 332, 348, 55, 83/345, 496, 501
See application file for complete search history.

(56) References Cited

U.S. PATENT DOCUMENTS

| | | | | |
|---|---|---|---|---|
| 4,671,152 | A * | 6/1987 | Blumle | 83/152 |
| 4,982,637 | A * | 1/1991 | Osborn | 83/346 |
| 2004/0182213 | A1* | 9/2004 | Wagner et al. | 83/343 |
| 2010/0167896 | A1* | 7/2010 | Hada et al. | 493/369 |

* cited by examiner

*Primary Examiner* — Hemant M Desai
(74) *Attorney, Agent, or Firm* — Rosenberg, Klein & Lee

(57) ABSTRACT

A rolling mechanism for having an opening perforation line on a plastic packaging film is disclosed, including a carriage frame, a pressure bearing unit, an impact cushioning mechanism, and an opening cutter assembly. The pressure bearing unit includes a pressure bearing seat, an anvil roll, and a retention plate, wherein the retention plate comprises a receptacle channel. The retention plate is used to position the anvil roll in the receptacle channel of the pressure bearing seat. The impact cushioning mechanism is coupled between the carriage frame and the pressure bearing seat. The opening cutter assembly is arranged adjacent to the anvil roll, which includes an opening cutter shaft and at least one opening cutter blade attached to the periphery of the opening cutter shaft. The opening cutter assembly is driven to rotate so as to have the opening cutter blade rolling on the anvil roll of the pressure bearing unit and an impact applied to the anvil roll or the pressure bearing unit is absorbed by the impact cushioning mechanism.

12 Claims, 12 Drawing Sheets

METHOD AND MECHANISM FOR ROLLING AN OPENING PERFORATION LINE

FIELD OF THE INVENTION

The present invention relates to a rolling mechanism, and in particular to a rolling mechanism for having an opening perforation line on a plastic packaging film and a method thereof.

BACKGROUND OF THE INVENTION

A packaged tissue paper pack available in the market requires a user to pull up a self-sticking label in order to tear an opening perforation line formed in a plastic packaging film, whereby an opening is formed to allow tissue paper sheets to be withdrawn from the tissue paper pack. The self-sticking label can be re-attached to close the opening. In the next time of use, the self-sticking label is peeled off again to allow withdrawal of the tissue paper sheets. This may be repeated several times until the tissue paper sheets are used up.

SUMMARY OF THE INVENTION

For the opening perforation line formed in the above described known plastic packaging film, in the first time of use, the perforation line must be torn apart by a user. The perforation line is formed by rolling with a perforation line rolling mechanism that comprises a rotatable anvil roller that is susceptible to wearing and must be replaced frequently. This waste the time in replacing the parts and makes the expense of replacing parts very high and thus leads to an increase of costs.

Thus, an objective of the present invention is to provide a rolling mechanism for having an opening perforation line on a plastic packaging film, wherein the impact force applied to an anvil roll of a pressure bearing unit can be reduced for reducing the wearing of the anvil roll.

Another objective of the present invention is to provide a rolling mechanism for having an opening perforation line on a plastic packaging film, wherein a contact edge of an anvil roll of a pressure bearing unit can be allowed to be changed in case of wearing of the contact edge.

A further objective of the present invention is to provide a rolling method for having an opening perforation line on a plastic packaging film, wherein an opening perforation line on a plastic packaging film can be formed by rolling under an impact reducing condition.

The solution adopted in the present invention to overcome the problems of the conventional techniques comprises rolling mechanism for having an opening perforation line on a plastic packaging film, which comprises a carriage frame, a pressure bearing unit, an impact cushioning mechanism, and an opening cutter assembly. The pressure bearing unit comprises a pressure bearing seat, an anvil roll, and a retention plate. The pressure bearing seat has a receptacle channel. The retention plate is engaged with the pressure bearing seat to position the anvil roll in the receptacle channel. The impact cushioning mechanism is coupled between the carriage frame and the pressure bearing seat to maintain a predetermined buffering gap between the carriage frame and the pressure bearing seat. The opening cutter assembly is arranged adjacent to the anvil roll of the pressure bearing unit. The opening cutter assembly comprises an opening cutter shaft and at least one opening cutter blade attached to a periphery of the opening cutter shaft. The opening cutter assembly is driven to rotate so as to have the opening cutter blade rolling on the anvil roll of the pressure bearing unit and an impact that is applied from the anvil roll or the pressure bearing unit is absorbed by the impact cushioning mechanism.

The anvil roll may get worn out after a long term use. A bolt that secures the retention plate to the pressure bearing seat is released to allow the anvil roll to be rotated by an angle by which an original contact edge that has been worn out is shifted away. The bolt is re-tightened to resume the secured condition of the retention plate to the pressure bearing seat. In this way, a new contact edge of the anvil roll is formed with respect to the opening cutter blade to receive subsequent forces applied thereto.

The technical solution provided by the present invention effectively improves the capability of an anvil roll, which is a part for forming an opening perforation line by rolling, for bearing impacts that act thereon caused by inconsistent assembled height of an opening cutter blade due to manufacturing tolerance or other factors and reduces the impacts applied to the anvil roll of the pressure bearing unit in the operation of the opening cutter assembly. The anvil roll is made a stationary part and comprises a high hardness material so that the lifespan is increased and the anvil roll can work to grind the opening cutter blade, making the anvil roll and the opening cutter blade better mating each other and the operation smooth. Further, the anvil roll of the pressure bearing unit, when worn out, can be operated to change the contact edge thereof, whereby the anvil roll can be repeatedly used for several times, reducing the frequency of replacing the anvil roll and thus saving costs.

BRIEF DESCRIPTION OF THE DRAWINGS

The present invention will be apparent to those skilled in the art by reading the following description of preferred embodiments of the present invention and the best mode for carrying out the present invention, with reference to the attached drawings, in which.

DETAILED DESCRIPTION OF THE PREFERRED EMBODIMENTS

Figure 1:
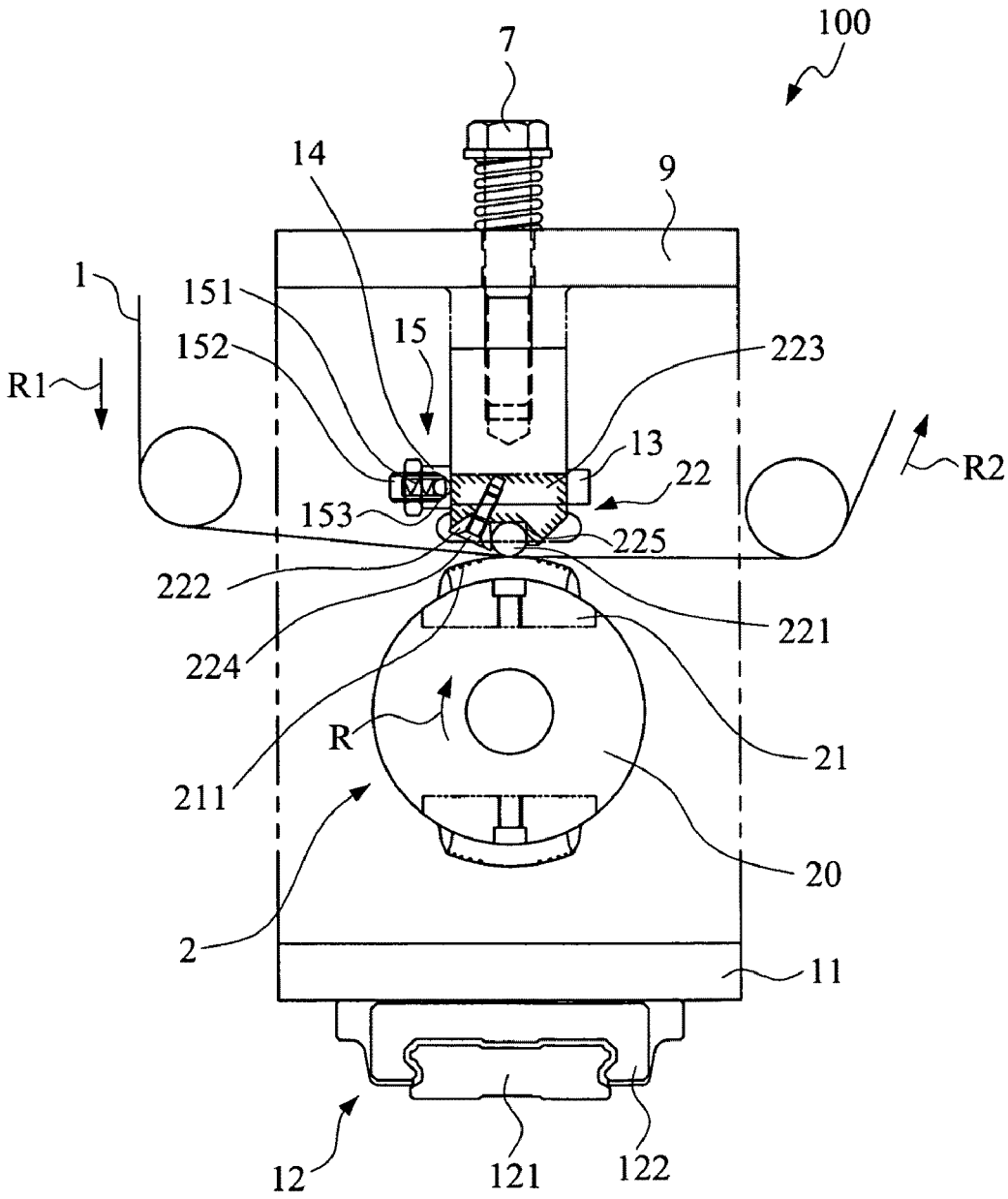
FIG. 1 is a schematic side elevational view of the present invention.
Figure 2:
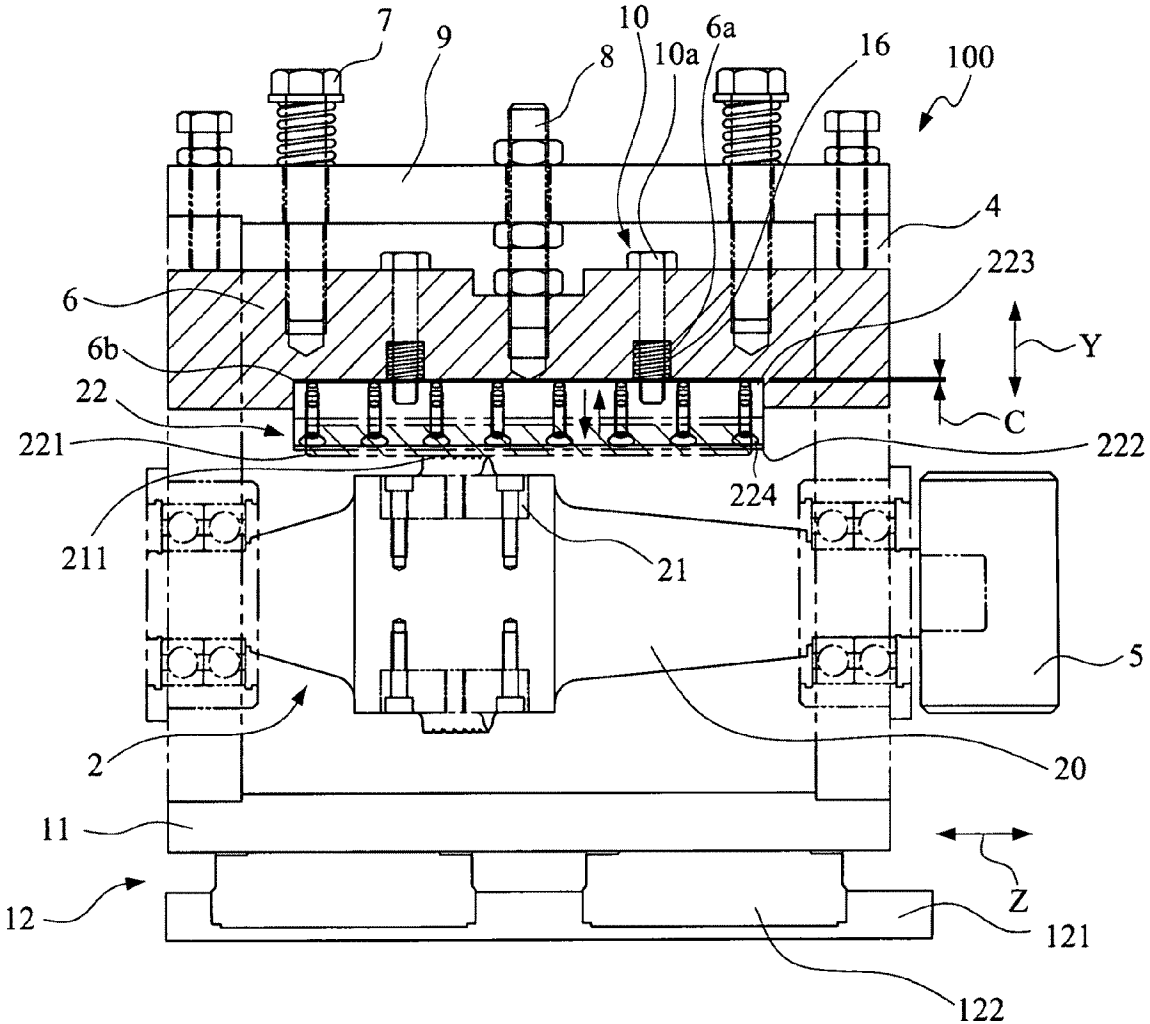
FIG. 2 is a schematic front view of the present invention.

With reference to the drawings and in particular to FIGS. 1 and 2, which show a schematic side elevational view and a schematic front view of the present invention respectively, a rolling mechanism for having an opening perforation line on a plastic packaging film, generally designated at 100, comprises a base frame 4, a carriage frame 6, at least one fastening bolt 7, a top board 9, a pressure bearing unit 22, an impact cushioning mechanism 10, and an opening cutter assembly 2. The top board 9 is mounted to the base frame 4 and the fastening bolt 7 extends through the top board 9 and engages the carriage frame 6.

The pressure bearing unit 22 comprises a pressure bearing seat 223, an anvil roll 221, and a retention plate 222. The pressure bearing seat 223 has a receptacle channel 225. The retention plate 222 is engaged with the pressure bearing seat 223 and is located at one side of the receptacle channel 225 in order to position the anvil roll 221 in the receptacle channel 225. The impact cushioning mechanism 10 is coupled between the carriage frame 6 and the pressure bearing seat 223 of the pressure bearing unit 22. In the instant embodiment, the pressure bearing unit 22 is made of a high hardness material, such as tungsten carbide. The anvil roll 221 possesses the capability of absorbing impact and vibration. Use of high hardness abrasion resistant material is helpful in increasing lifespan of the anvil roll 221.

The impact cushioning mechanism 10 comprises at least one bolt 10*a* and at least one pressure bearing spring 16. The bolt 10*a* extends through the carriage frame 6 and engages the pressure bearing seat 223 of the pressure bearing unit 22. The pressure bearing spring 16 is set in a respective cavity 6*a* formed within the carriage frame 6 and is sleeved around the bolt 10*a*. Opposite ends of the pressure bearing spring 16 are respectively supported by the cavity 6*a* and the pressure bearing seat 223 for adjusting a penetration depth with respect to the bolt 10*a* fastening. The pressure bearing spring 16 provides resiliency that maintains a Y-axis buffering gap C (approximately 2-0.4 mm) between the carriage frame 6 and the pressure bearing seat 223 of the pressure bearing unit 22.

A regulating bolt 8 extends through the top board 9 and engages the carriage frame 6. The regulating bolt 8 is used for adjusting a distance between the carriage frame 6 and the top board 9 to result that a distance between the pressure bearing unit 22 and an opening cutter shaft 20 is adjusted correspondingly to ensure effective rolling and smooth operation between the anvil roll 221 and an opening cutter blade 211.

The opening cutter assembly 2 is arranged adjacent to the anvil roll 221 of the pressure bearing unit 22 and comprises the opening cutter shaft 20, at least one opening cutter seat 21, and at least one opening cutter blade 211. The opening cutter seat 21 is coupled to the opening cutter shaft 20, and the opening cutter blade 211 is mounted to the opening cutter seat 21. The opening cutter shaft 20 is coupled to the base frame 4 and is indirectly driven by a motor (not shown) via a pulley 5 to rotate in a rotation direction R.

A plastic packaging film 1 is fed along a feeding path R1 into the rolling mechanism for having an opening perforation line on a plastic packaging film 100 and is rolled between the opening cutter blade 211 of the opening cutter assembly 2 and the anvil roll 221 of the pressure bearing unit 22 whereby an opening perforation line 3 (also see FIG. 9) is formed at a predetermined location in the plastic packaging film 1, and the plastic packaging film 1 is then discharged along a discharge path R2. The plastic packaging film 1 is a pliable thin film material.

The rolling mechanism for having an opening perforation line on a plastic packaging film 100 further comprises a bottom board 11 and a rail assembly 12. The rail assembly 12 comprises a rail 121 and at least one slide block 122. The bottom board 11 is coupled to an underside of the base frame 4 and the slide block 122 of the rail assembly 12 is coupled to the bottom board 11. The rail 121 is coupled to a base of other assemblies/units (not shown in the drawings). The rolling mechanism for having an opening perforation line on a plastic packaging film 100 is controlled by a screw control unit (not shown) to have the slide block 122 sliding on the rail 121 along Z axis for setting the anvil roll 221 and the opening cutter blade 211 to roll and form the opening perforation line 3 at a desired and correct location on the plastic packaging film 1.

Figure 3:
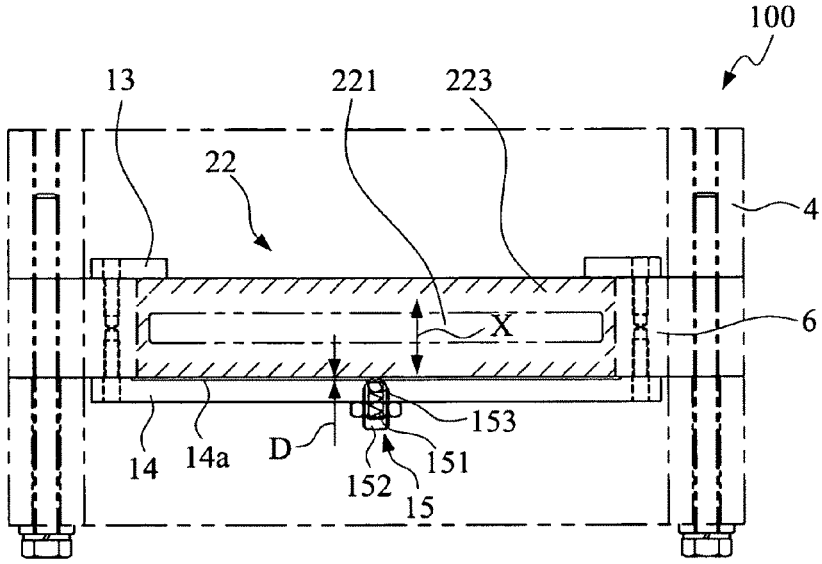
FIG. 3 is a schematic top plan view of the present invention.

Referring to FIG. 3, which shows a schematic top plan view of the present invention, a plurality of short retention blocks 13 is fixed to the carriage frame 6 to secure the pressure bearing seat 223 of the pressure bearing unit 22 and a long retention bar 14 is engaged to an opposite side of the carriage frame 6. The long retention bar 14 has a groove 14*a* forming a surface that defines an X-axis buffering gap D (approximately 2-0.4 mm) between the long retention bar 14 and the pressure bearing seat 223.

The long retention bar 14 is provided, at a substantially central portion, with a resilient cushioning mechanism 15, which can be for example composed of a resiliently biased positioning bead that is readily available from the market. In the embodiment illustrated, the resilient cushioning mechanism 15 generally comprises a regulation spring 151, a resilient bolt 152, and a pressure bearing end 153. The resilient bolt 152 has an end extending into the groove 14*a* of the long retention bar 14 to have the pressure bearing end 153 against the pressure bearing seat 223 of the pressure bearing unit 22. The regulation spring 151, or an equivalent resilient element, constituting the resilient cushioning mechanism 15, provides the function of cushioning to absorb the power of impact and vibration. When the anvil roll 221 or the pressure bearing unit 22 is subjected to an external force, the presence of the resilient cushioning mechanism 15 provides the anvil roll 221 or the pressure bearing unit 22 with the capability of absorbing impacts and vibrations along the X axis.

Figure 4:
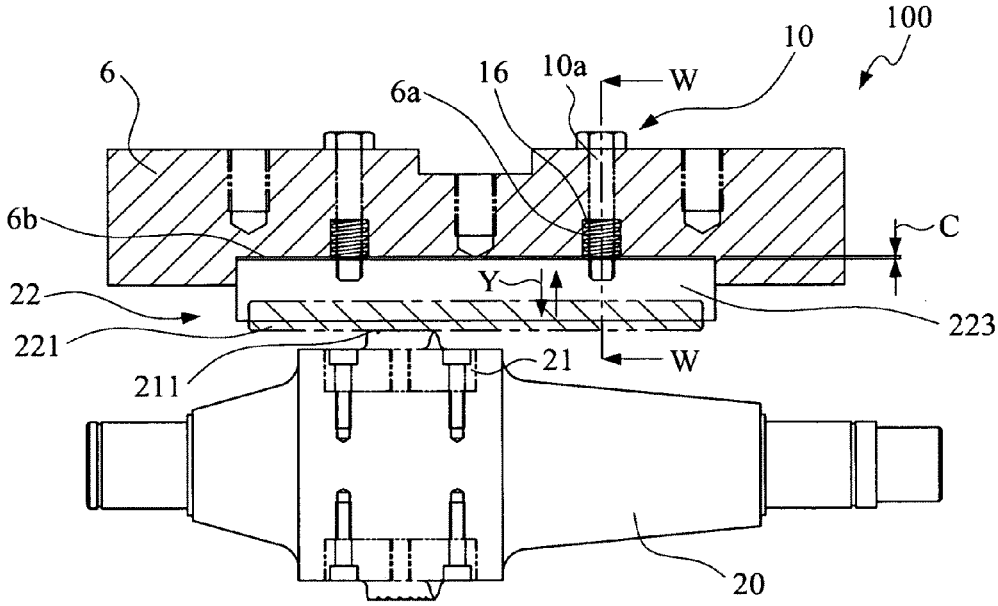
FIG. 4 is a schematic front view of the present invention, showing a pressure bearing unit coupled to a carriage frame.

Referring to FIG. 4, which is a schematic front view of the present invention showing the pressure bearing unit coupled to the carriage frame, the pressure bearing spring 16 of the impact cushioning mechanism 10 is set in the cavity 6*a* of the carriage frame 6 and sleeves around the outer circumference of the bolt 10*a*. The bolt 10*a* is screwed into the pressure bearing seat 223 of the pressure bearing unit 22 and properly adjusted to have a surface of the grooved channel 6*b* that is formed in a central portion of the carriage frame 6 defining the Y-axis buffering gap C with respect to the pressure bearing seat 223 of the pressure bearing unit 22. Thus, when the anvil roll 221 or the pressure bearing unit 22 is subjected to an external force, the presence of the pressure bearing spring 16 of the impact cushioning mechanism 10 provides the anvil roll 221 or the pressure bearing unit 22 with the capability of absorbing impacts and vibrations along the Y axis.

Figure 5:
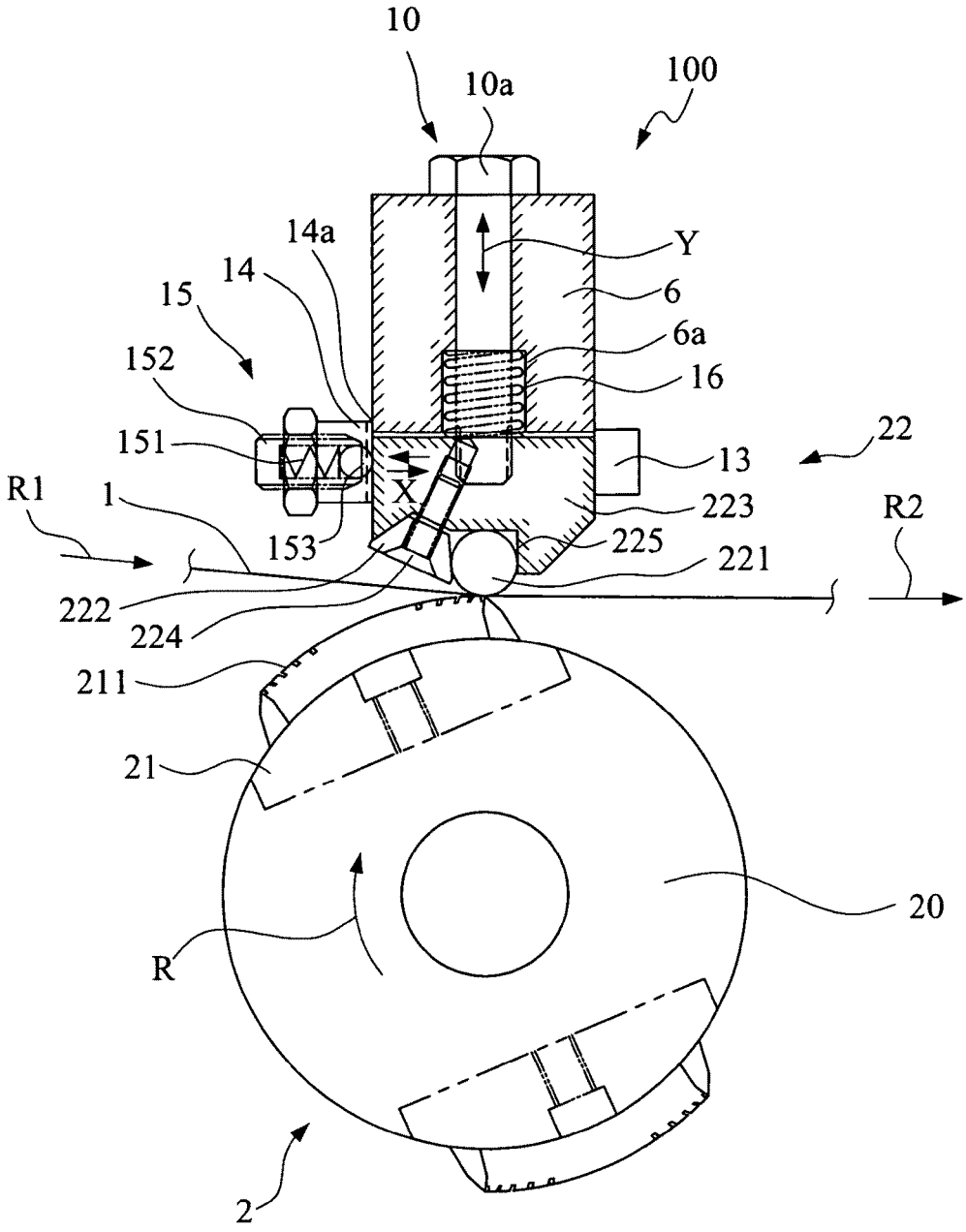
FIG. 5 shows an initial phase when an opening cutter shaft of the present invention is rotated to have an opening cutter blade thereof making an initial rolling engagement with an anvil roll, wherein an impact cushioning mechanism, the carriage frame, and the pressure bearing unit are shown in cross-sectional form taken along line W-W of FIG. 4.
Figure 6:
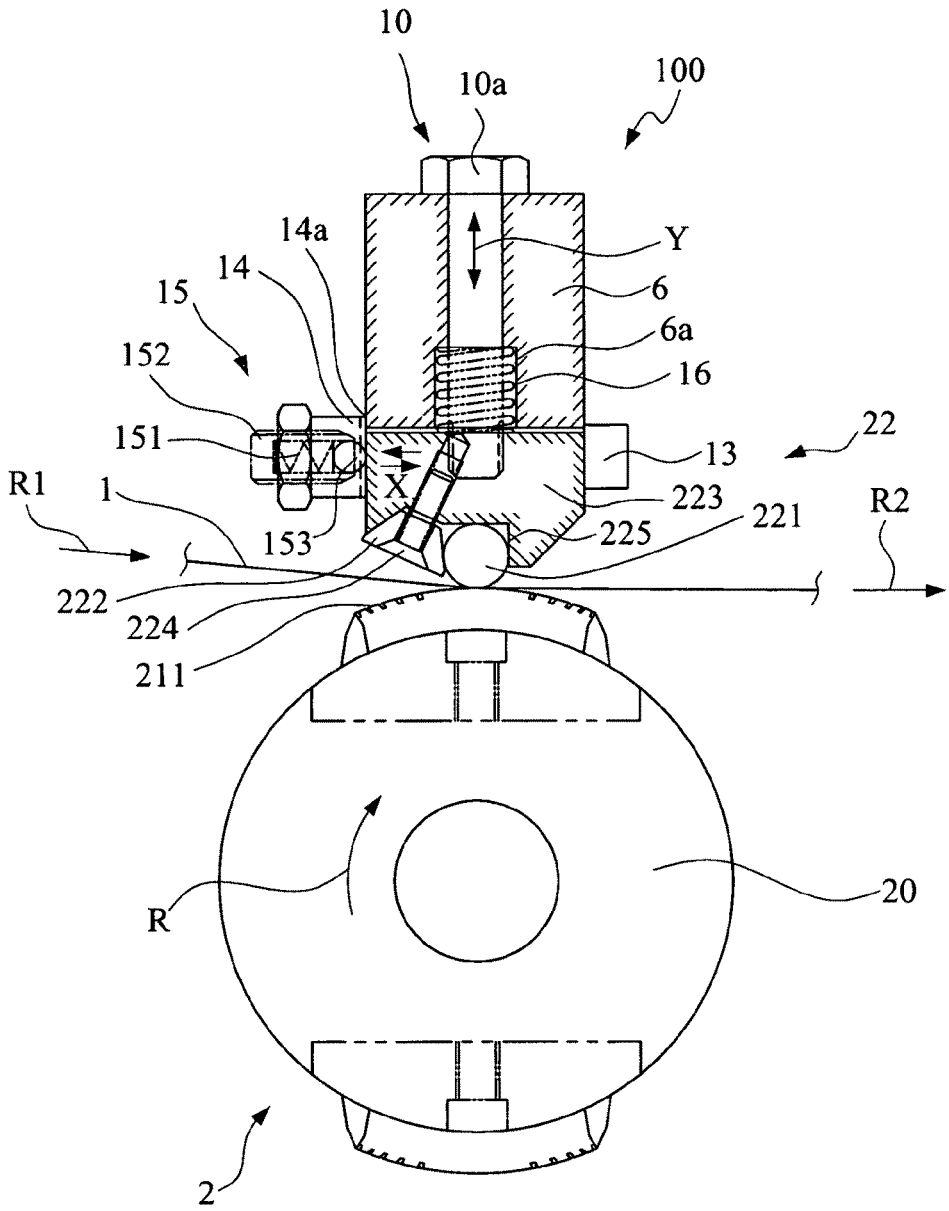
FIG. 6 shows an intermediate phase when the opening cutter shaft of the present invention is rotated to have the opening cutter blade thereof making rolling engagement with the anvil roll with an intermediate portion thereof, wherein the impact cushioning mechanism, the carriage frame, and the pressure bearing unit are shown in cross-sectional form taken along line W-W of FIG. 4.
Figure 7:
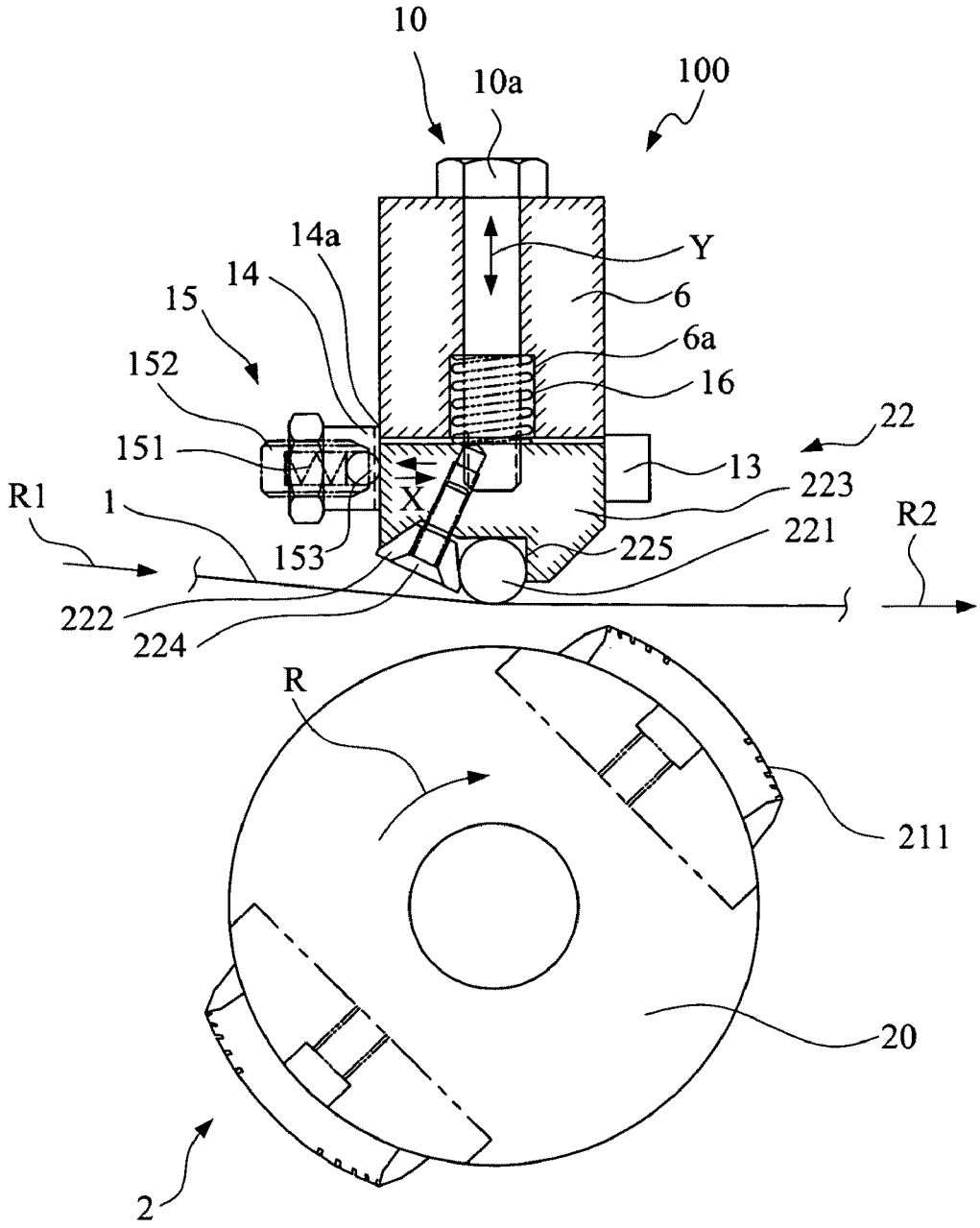
FIG. 7 shows a final phase when the opening cutter shaft of the present invention is rotated to have the opening cutter blade thereof disengaged from the anvil roll, wherein the impact cushioning mechanism, the carriage frame, and the pressure bearing unit are shown in cross-sectional form taken along line W-W of FIG. 4, wherein the impact cushioning mechanism, the carriage frame, and the pressure bearing unit are shown in cross-sectional form taken along line W-W of FIG. 4.

Reference is simultaneously made to FIGS. 5-7, in which the impact cushioning mechanism, the carriage frame, and the pressure bearing unit are shown in cross-sectional form taken along line W-W of FIG. 4. FIG. 5 shows an initial phase when the opening cutter shaft in accordance with the present invention is rotated to have the opening cutter blade thereof making an initial rolling engagement with the anvil roll. FIG. 6 shows an intermediate phase when the opening cutter shaft in accordance with the present invention is rotated to have the opening cutter blade thereof making rolling engagement with the anvil roll with an intermediate portion thereof. FIG. 7 shows a final phase when the opening cutter shaft in accordance with the present invention is rotated to have the opening cutter blade thereof disengaged from the anvil roll. As shown, when the plastic packaging film 1 is fed into the rolling mechanism for having an opening perforation line on a plastic packaging film 100, the plastic packaging film 1 is subjected to rolling between the anvil roll 221 and the opening cutter blade 211 to form the opening perforation line 3. The impact force that the opening cutter blade 211 applies to the anvil roll 221 is buffered by the resilient cushioning mechanism 15 so that the impact and vibration along the X axis are effectively absorbed. Further, the pressure bearing spring 16 of the impact cushioning mechanism 10 absorbs the impact and vibration that the opening cutter blade 211 induces on the anvil roll 221 along the Y axis.

Figure 8:
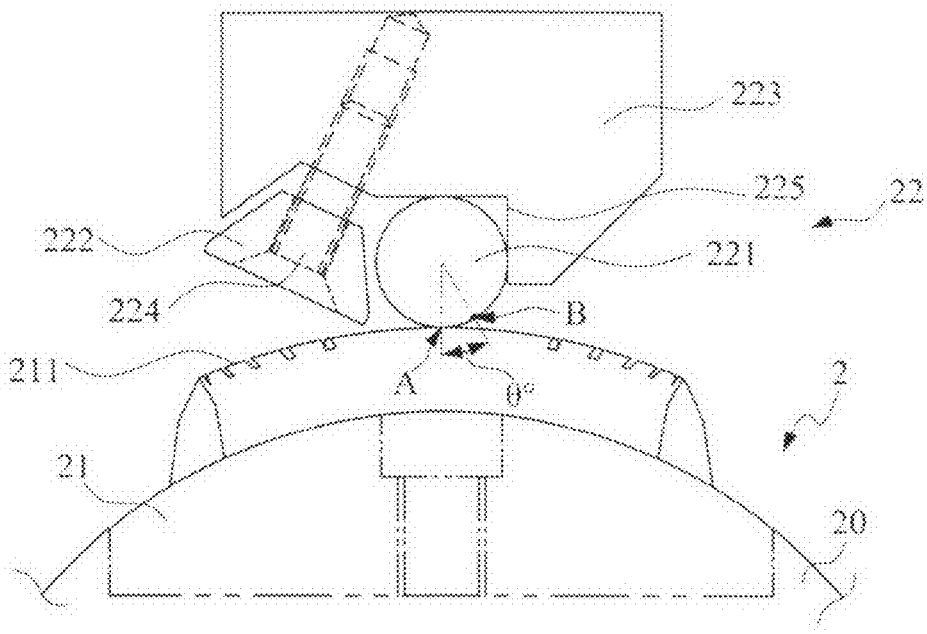
FIG. 8 is a local side elevational view of the present invention, illustrating positional change of the contact edge of the anvil roll with respect to the opening cutter blade.

Referring to FIG. 8, a local side elevational view of the present invention is shown to illustrate change of the contact edge of the anvil roll with respect to the opening cutter blade. As shown, the pressure bearing unit 22 comprises at least one bolt 224 (only one being visible in FIG. 8). When the bolt 224 is in a tightened condition (see FIG. 7), the retention plate 222 is engaged with the pressure bearing seat 223 and located at one side of the receptacle channel 225, whereby the anvil roll 221 is set to have an initial contact edge B facing the opening cutter assembly 2 in a given direction and when the opening cutter shaft 20 of the opening cutter assembly 2 is driven to rotate, the initial contact edge B of the anvil roll 221 engages and receives the rolling operation applied by the opening cutter blade 211. When the anvil roll 221 is worn out due to a long term operation, the bolt 224 that secures the retention plate 222 to the pressure bearing seat 223 is released to have the bolt 224 set in an un-tightened condition (see FIG. 8), and the anvil roll 221 is thus allowed to be rotated by an angle θ within the receptacle channel 225 of the pressure bearing seat 223 to shift away the worn contact edge B. The bolt 224 is then tightened again to re-secure the retention plate 222 to the pressure bearing seat 223, whereby a new contact edge A is provided between the anvil roll 221 and the opening cutter blade 211 and the new contact edge A will take any rolling force applied thereto in the subsequent operation. In this way, the anvil roll 221 can be repeatedly used for several times, whereby the frequency of replacing the anvil roll 221 is reduced and the cost of replacing the anvil roll 221 is saved.

Figure 9:
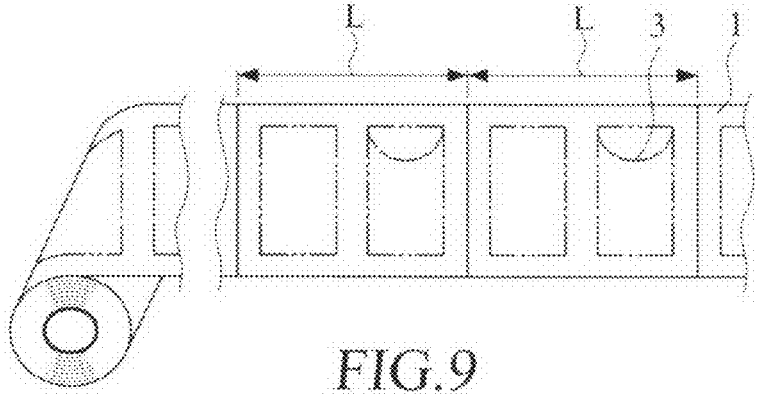
FIG. 9 is a schematic perspective view of a plastic packaging film used in the present invention.
Figure 10:
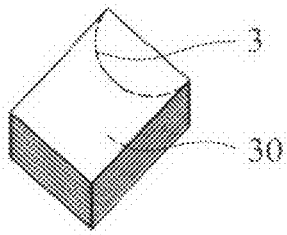
FIG. 10 is a schematic perspective view of a packaged tissue pack in accordance with the present invention.

With simultaneous reference to both FIGS. 9 and 10, of which FIG. 9 shows a schematic perspective view of a plastic packaging film used in the present invention and FIG. 10 illustrates a schematic perspective view of a packaged tissue pack in accordance with the present invention. As shown, the plastic packaging film 1, after subjected to rolling operation by the opening cutter blade 211 and the anvil roll 221, forms an opening perforation line 3 at every predetermined interval or distance L. A predetermined number of tissue paper sheets are packaged with the plastic packaging film 1 to form a tissue pack 30. By tearing off the opening perforation line 3 that is formed in the tissue pack 30, the tissue paper sheets can be withdrawn for use.

Figure 11:
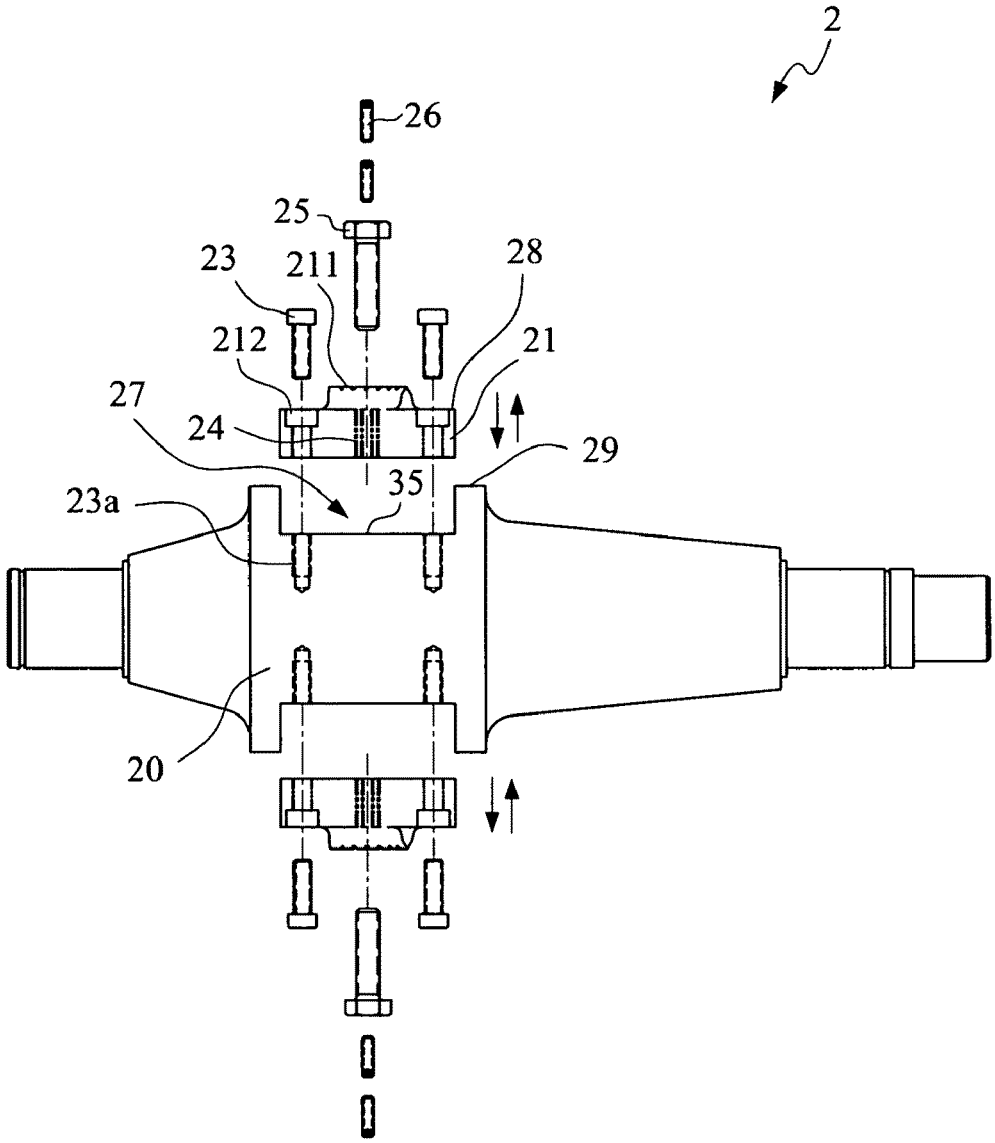
FIG. 11 is a schematic plan view of the opening cutter assembly in accordance with the present invention.
Figure 12:
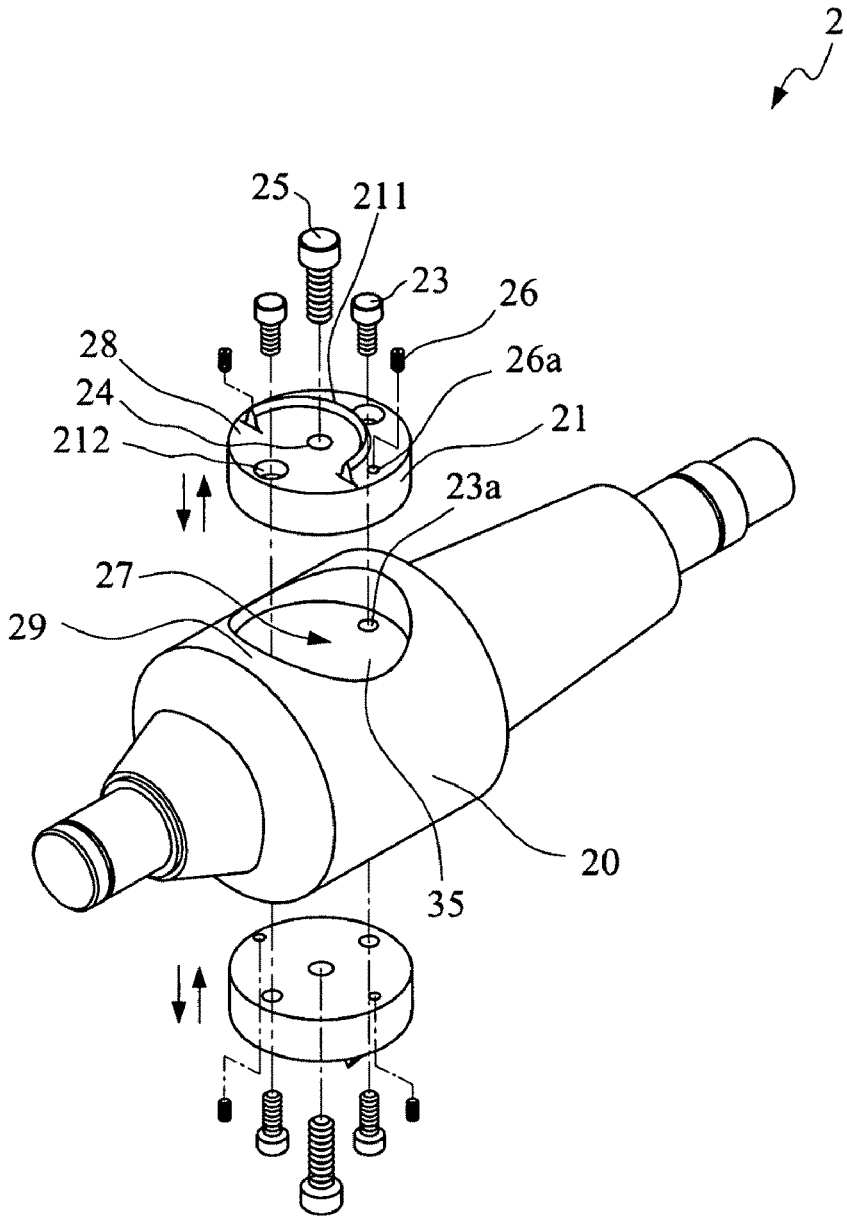
FIG. 12 is a schematic perspective view of the opening cutter assembly of the present invention.
Figure 13:
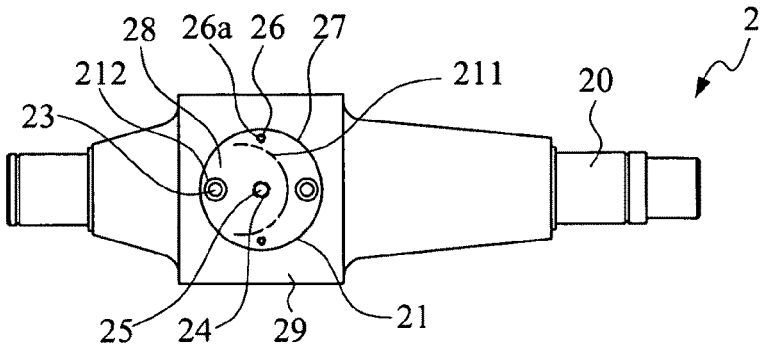
FIGS. 13-16 are top plan views showing, respectively, various configurations of the opening cutter blade provided in the opening cutter assembly of the present invention.
Figure 14:
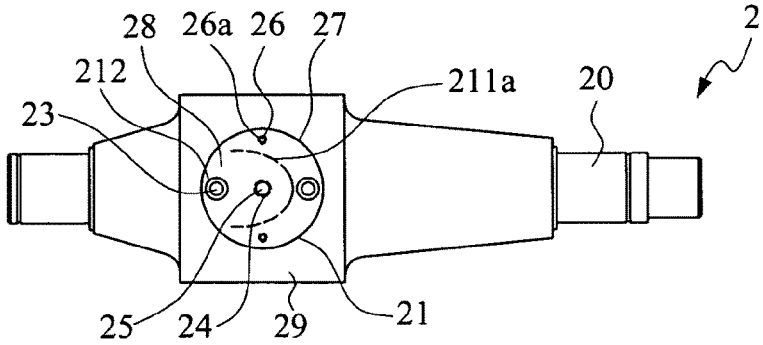
Figure 15:
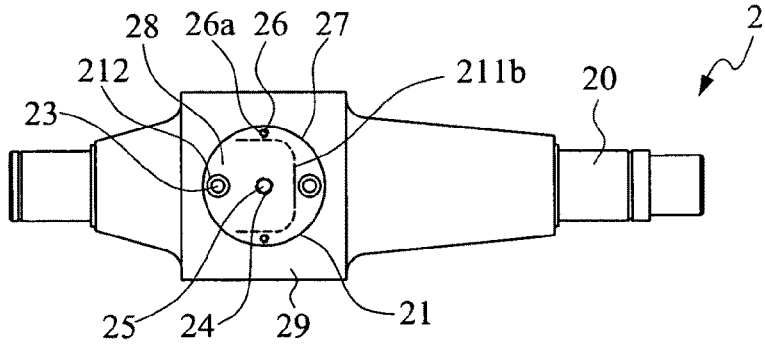
Figure 16:
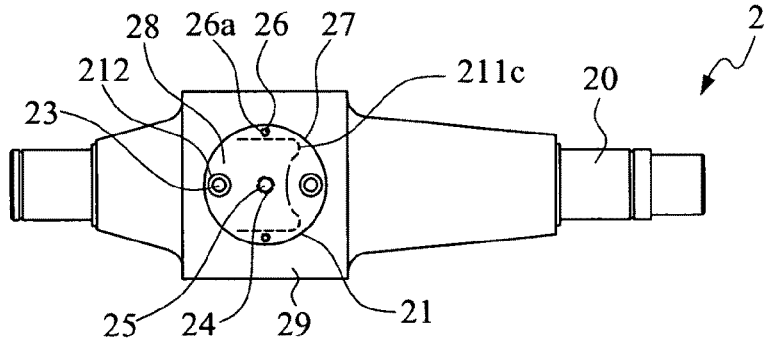
Figure 17:
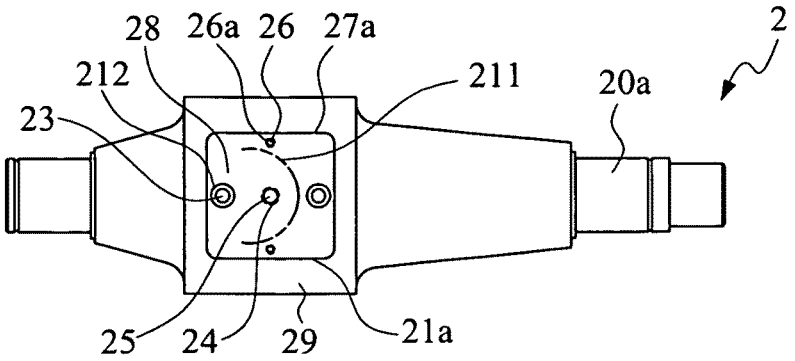
FIGS. 17-20 are top plan views showing, respectively, various configurations of the opening cutter seat provided for the opening cutter assembly of the present invention.
Figure 18:
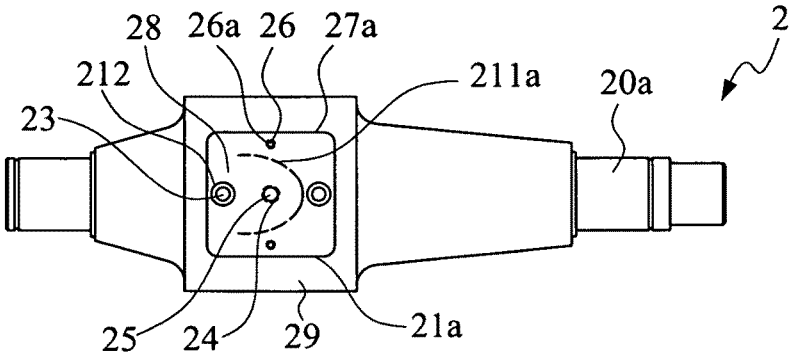
Figure 19:
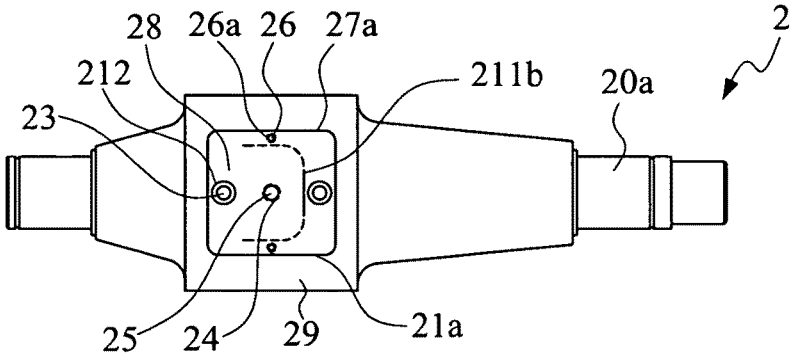
Figure 20:
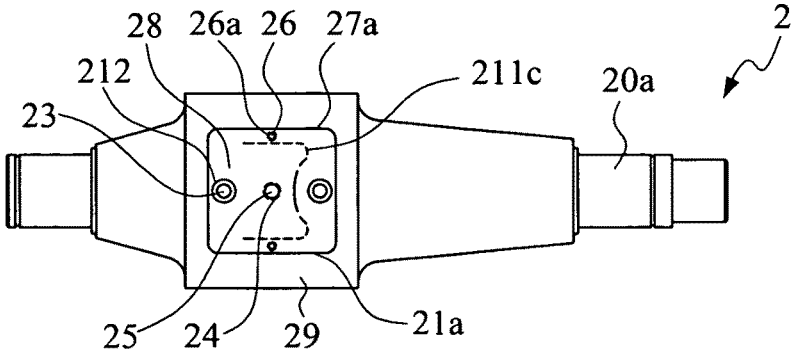

Reference is now made simultaneously to FIGS. 11 and 12, of which FIG. 11 is a schematic plan view of the opening cutter assembly in accordance with the present invention and FIG. 12 is a schematic perspective view of the opening cutter assembly of the present invention. As shown, the opening cutter shaft 20 of the opening cutter assembly 2 has at least one containing compartment 27 that has a bottom 35. The bottom 35 defines at least one threaded cutter hole 23*a*.

The opening cutter seat 21 of the opening cutter assembly 2 is accommodated in and engaged to the corresponding containing compartment 27 of the opening cutter shaft 20 and forms at least one post hole 212 respectively corresponding to the cutter hole 23*a* of the opening cutter shaft 20. The opening cutter blade 211 is mounted to the opening cutter seat 21 and the opening cutter assembly 2 uses cutter bolts 23 to fasten the post holes 212 of the opening cutter seat 21 and the cutter holes 23*a* of the opening cutter shaft 20 to have the opening cutter seat 21 engaging with the opening cutter shaft 20.

The opening cutter seat 21 of the opening cutter assembly 2 is provided with a threaded removal hole 24 and at least one threaded adjustment hole 26*a*. When there is a need to replace a long-term used and thus worn opening cutter blade 211 or to replace one having a different configuration, an operator releases the cutter bolts 23 and then screws at least one removal bolt 25 into the removal hole 24 to a predetermined depth, whereby the operator may use his or her hand or a tool to grip a free end of the removal bolt 25 to remove the opening cutter seat 21. Then, a new opening cutter seat 21 can be installed and the cutter bolts 23 are tightened again to complete the replacement operation of the opening cutter seat 21. When the opening cutter assembly 2 of the rolling mechanism for having the opening perforation line on the plastic packaging film 100 is set in operation, the removal bolt 25 must be removed first in order to prevent the anvil roll 221 from being struck by the removal bolt 25 in the rolling operation.

The opening cutter seat 21 has an end surface 28 and the opening cutter shaft 20 has a cylindrical surface 29. In case it is found that the end surface 28 of the opening cutter seat 21 and the cylindrical surface 29 of the opening cutter shaft 20 do not match with each other along the outer cylindrical contour, or the anvil roll 221 and the opening cutter blade 211 cannot carry out rolling operation properly, the cutter bolts 23 are first released and an adjustment bolt 26 engaging the adjustment hole 26*a* is adjusted in such a way that when the adjustment bolt 26 gets into contact with the bottom 35 of the containing compartment 27 of the opening cutter shaft 20, further rotating the adjustment bolt 26 in either clockwise direction or counterclockwise direction may adjust the assembled height of the opening cutter seat 21 and when a desired height is reached, the cutter bolts 23 are firmly secured. This operation can be carried out repeatedly until the anvil roll 221 and the opening cutter blade 211 can properly carry out rolling operation and a uniform opening perforation line 3 is formed at a predetermined location in the plastic packaging film 1.

The adjustment hole 26*a* that engages the adjustment bolt 26 can be set at any desired location in the opening cutter seat 21 of the opening cutter assembly 2 according to practical needs. The adjustment bolt 26 can be a bolt having a consistent diameter through the whole bolt body thereof and can be one available from the market. The cutter bolts 23 and the removal bolt 25 can also be bolts that are readily available from the market. The cutter bolts 23 are preferably of the type of countersink bolt.

Referring to FIGS. 13-16, various configurations of the opening cutter blade provided for the opening cutter assembly of the present invention are shown. As shown, the opening cutter seat 21 of the opening cutter assembly 2 has a cylindrical body carrying an opening cutter blade 211 that can be a semi-circular blade 211, a curved blade 211*a*, a rectangular blade 211*b*, or an M-shaped blade 211*c*.

Referring to FIGS. 17-20, various configurations of the opening cutter seat provided for the opening cutter assembly of the present invention are shown. As shown, the opening cutter seat 21*a* of the opening cutter assembly 2 can be formed as a rectangular body and the opening cutter shaft 20*a* of the opening cutter assembly 2 forms a rectangular containing compartment 27*a* corresponding to the rectangular body of the opening cutter seat 21*a*.

Figure 21:
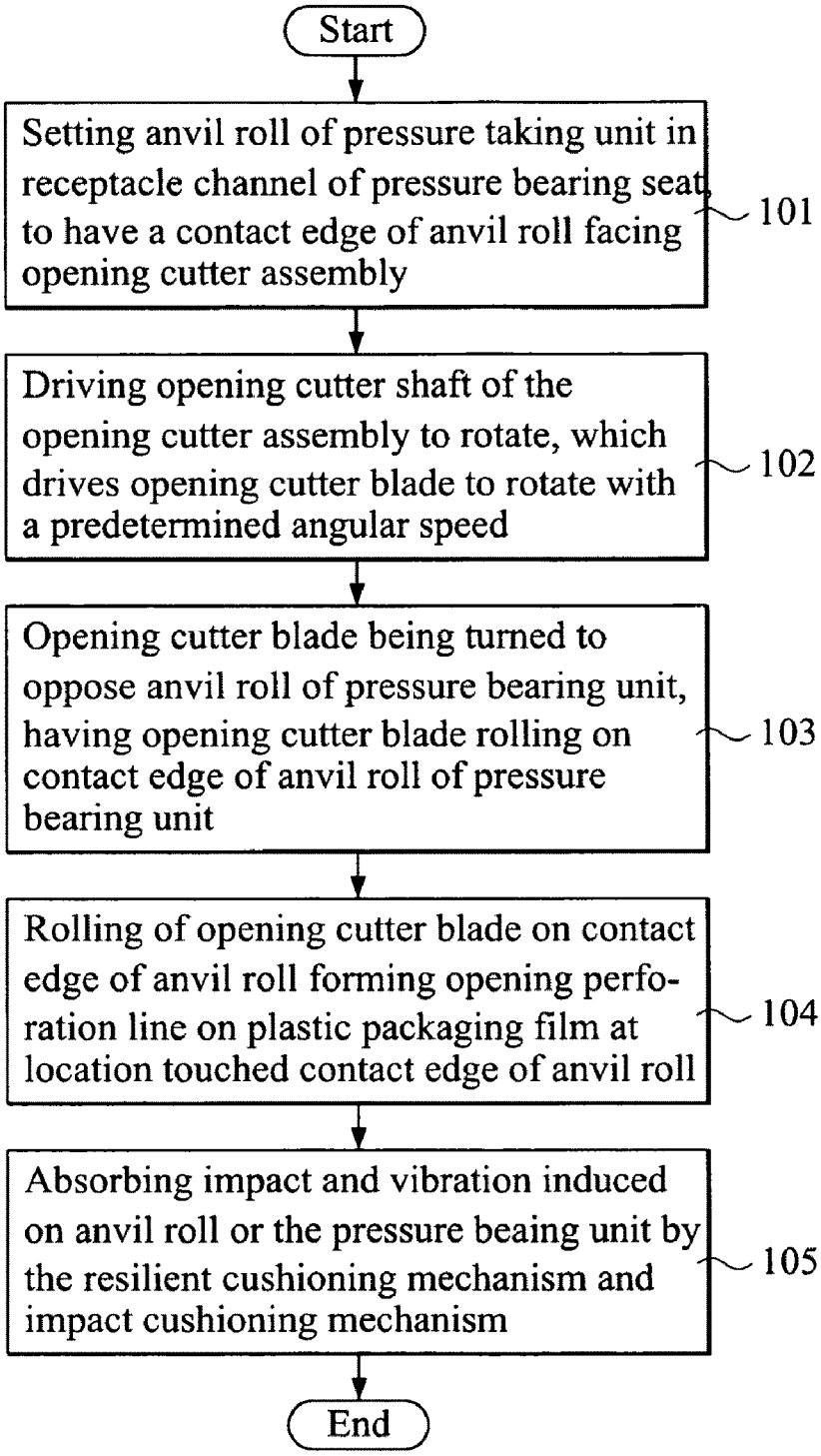
FIG. 21 shows a flowchart demonstrating an operation of the present invention.

Referring to FIG. 21, a flowchart demonstrating an operation of the present invention is shown. As shown, the anvil roll 221 of the pressure bearing unit 22 is set in the receptacle channel 225 of the pressure bearing seat 223 to have a contact edge of the anvil roll facing the opening cutter assembly 2 (Step 101). The opening cutter shaft 20 of the opening cutter assembly 2 is driven to rotate and the opening cutter blade 211 rotates with a predetermined angular speed (Step 102) and reaches the site where the opening cutter blade 211 opposes the anvil roll 221 of the pressure bearing unit 22 to have the opening cutter blade 211 rolling on the contact edge of the anvil roll 221 of the pressure bearing unit 22 (Step 103). Since the opening cutter blade 211 is rolled on the contact edge of the anvil roll 221, the plastic packaging film 1 forms an opening perforation line 3 at a location of which is touched the contact edge of the anvil roll (Step 104). Impact and vibration induced on the anvil roll 221 or the pressure bearing unit 22 are absorbed by the resilient cushioning mechanism 15 and the impact cushioning mechanism 10 (Step 105).

If necessary, an operation that angularly shifts the anvil roll 221 in the receptacle channel 225 of the pressure bearing seat 223 by an angle θ is carried out to angularly shift away the initial contact edge B of the anvil roll 221, which may be worn out, and has a new contact edge A to face the opening cutter assembly 2 instead of the worn contact edge B.

Since the present invention comprises a resilient cushioning mechanism 15, which absorbs the X-axis impact force applied from the opening cutter blade 211 to the anvil roll 221 or the pressure bearing unit 22, when the anvil roll 221 or the pressure bearing unit 22 is receiving a force acting thereon, due to the resilient cushioning mechanism 15, the anvil roll 221 or the pressure bearing unit 22 is provided with the capability of absorbing impact and vibration along the X axis. Further, the present invention comprises an impact cushioning mechanism 10, which absorbs the Y-axis impact force applied from the opening cutter blade 211 to the anvil roll 221 or the pressure bearing unit 22, when the anvil roll 221 or the pressure bearing unit 22 is receiving a force acting thereon, due to the impact cushioning mechanism 10, the anvil roll 221 or the pressure bearing unit 22 is provided with the capability of absorbing impact and vibration along the Y axis. In other words, the impact and/or vibration applied in any direction from the opening cutter blade 211 to the anvil roll 221 or the pressure bearing unit 22 can be effectively buffered.

Although the present invention has been described with reference to the preferred embodiments thereof and the best mode for carrying the invention, it is apparent to those skilled in the art that a variety of modifications and changes may be made without departing from the scope of the present invention which is intended to be defined by the appended claims.

What is claimed is:

1. A rolling mechanism for having an opening perforation line on a plastic packaging film, comprising:

a carriage frame;

a pressure bearing unit, comprising:

a pressure bearing seat, having a receptacle channel;

an anvil roll, positioned in the receptacle channel of the pressure bearing seat; and a retention plate, which is engaged with the pressure bearing seat and is located at one side of the receptacle channel to have the anvil roll retained in the receptacle channel of the pressure bearing seat;

an impact cushioning mechanism, which is coupled between the carriage frame and the pressure bearing seat of the pressure bearing unit; and an opening cutter assembly, which is arranged adjacent to the anvil roll of the pressure bearing unit and comprises a rotatable opening cutter shaft and at least one opening cutter blade mounted to the opening cutter shaft;

wherein when the opening cutter assembly is driven to rotate so as to have the opening cutter blade rolling on the anvil roll of the pressure bearing unit, an impact is applied to the anvil roll and absorbed by the impact cushioning mechanism, whereby the anvil roll can endure the impact applied thereto.

2. The rolling mechanism as claimed in claim 1 further comprising a base frame, a top board, and at least one fastening bolt, wherein the top board is mounted to the base frame and the fastening bolt extends through the top board to engage the carriage frame.

3. The rolling mechanism as claimed in claim 1 further comprising a regulating bolt, which extends through the top board to engage the carriage frame, wherein the regulating bolt is used for adjusting a distance between the carriage frame and the top board to result that the distance between the pressure bearing unit and an opening cutter shaft is adjusted correspondingly.

4. The rolling mechanism as claimed in claim 1, wherein the impact cushioning mechanism comprises at least one bolt and at least one pressure bearing spring, the bolt extending through the carriage frame to engage the pressure bearing seat of the pressure bearing unit, the pressure bearing spring being set in each cavity formed within the carriage frame and being sleeved around the bolt, opposite ends of the pressure bearing spring being respectively supported by the cavity and the pressure bearing seat for adjusting a penetration depth with respect to the bolt fastening, the pressure bearing spring providing resiliency that maintains a Y-axis buffering gap between the carriage frame and the pressure bearing seat of the pressure bearing unit.

5. The rolling mechanism as claimed in claim 1 further comprising:

a long retention bar, which is engaged to one side of the carriage frame, having a groove that forms an X-axis buffering gap between the long retention bar and the pressure bearing seat; and a resilient cushioning mechanism, which comprises a resilient bolt and a pressure bearing end, the resilient bolt having an end extending into the groove of the long retention bar to have the pressure bearing end against the pressure bearing seat of the pressure bearing unit, whereby when the anvil roll is on an external force, the resilient cushioning mechanism is applied to allow the anvil roll to bear an impact along the X axis.

6. The rolling mechanism as claimed in claim 1, wherein the anvil roll comprises a high hardness material.

7. The rolling mechanism as claimed in claim 1, wherein the pressure bearing unit comprises at least one bolt, and wherein when the bolt is set in a tightened condition, the retention plate is engaged with the pressure bearing seat and located at one side of the receptacle channel, whereby the anvil roll is set to have a contact edge thereof facing the opening cutter assembly and when the opening cutter shaft of the opening cutter assembly is driven to rotate, the contact edge of the anvil roll is rolled by the opening cutter blade.

8. The rolling mechanism as claimed in claim 7, wherein when the bolt is set in an un-tightened condition, the anvil roll is allowed to be rotated by an angle within the receptacle channel of the pressure bearing seat to angularly shift away the contact edge for having a new contact edge facing the opening cutter assembly instead of the worn contact edge.

9. A method for rolling an opening perforation line in a plastic packaging film, wherein a carriage frame is provided with a pressure bearing unit and an opening cutter assembly arranged adjacent to the pressure bearing unit, the pressure bearing unit comprising a pressure bearing seat that defines a receptacle channel, a retention plate, and an anvil roll, an impact cushioning mechanism coupled between the carriage frame and the pressure bearing seat of the pressure bearing unit, a long retention bar engaged to one side of the carriage frame, a resilient cushioning mechanism being provided at a central portion of the long retention bar, the opening cutter assembly comprising a rotatable opening cutter shaft and at least one opening cutter blade mounted to the opening cutter shaft, the method comprising the following steps:

(a) setting the anvil roll of the pressure bearing unit in the receptacle channel of the pressure bearing seat to have a contact edge of the anvil roll facing the opening cutter assembly;

(b) rotating the opening cutter shaft of the opening cutter assembly to drive the opening cutter blade to rotate with a predetermined angular speed;

(c) having the opening cutter blade rolling on the contact edge of the anvil roll of the pressure bearing unit at the time when the opening cutter blade rotates to reach a position corresponding to the anvil roll of the pressure bearing unit;

(d) rolling to form the opening perforation line on the plastic packaging film, at a location of which is touched the contact edge of the anvil roll since the opening cutter blade is rolled on the contact edge of the anvil roll; and (e) absorbing an impact applied to the anvil roll with the resilient cushioning mechanism and the impact cushioning mechanism so as to allow the anvil roll to bear the impact.

10. The method as claimed in claim 9, wherein the step (a) further comprises the step of angularly shifting the anvil roll in the receptacle channel of the pressure bearing seat by an angle to angularly shift away the contact edge of the anvil roll and have a new contact edge facing the opening cutter assembly.

11. The method as claimed in claim 9, wherein the resilient cushioning mechanism absorbs an impact applied from the opening cutter blade to the anvil roll along an X axis direction with respect to the step (e).

12. The method as claimed in claim 9, wherein the impact cushioning mechanism absorbs an impact applied from the opening cutter blade to the anvil roll along a Y axis direction with respect to the step (e).

* * * * *